US007677044B2

(12) United States Patent
Barbeln et al.

(10) Patent No.: US 7,677,044 B2
(45) Date of Patent: Mar. 16, 2010

(54) HEAT SHIELD

(75) Inventors: Claudia Barbeln, Oberhausen (DE); Olga Deiss, Düsseldorf (DE); Jens Kleinfeld, Mülheim an der Ruhr (DE); Marc Tertilt, Hattingen (DE); Bernd Vonnemann, Gladbeck (DE)

(73) Assignee: Siemens Aktiengesellschaft, Munich (DE)

( * ) Notice: Subject to any disclaimer, the term of this patent is extended or adjusted under 35 U.S.C. 154(b) by 813 days.

(21) Appl. No.: 10/586,233

(22) PCT Filed: Dec. 16, 2004

(86) PCT No.: PCT/EP2004/053534

§ 371 (c)(1),
(2), (4) Date: Jul. 18, 2006

(87) PCT Pub. No.: WO2005/071320

PCT Pub. Date: Aug. 4, 2005

(65) Prior Publication Data

US 2007/0151249 A1 Jul. 5, 2007

(30) Foreign Application Priority Data

Jan. 27, 2004 (EP) ..... 04001689

(51) Int. Cl.
*F02C 1/00* (2006.01)
*F02G 3/00* (2006.01)

(52) U.S. Cl. ..... 60/752; 60/753; 60/796; 60/800; 277/641; 277/643

(58) Field of Classification Search ..... 60/752, 60/753, 796, 800; 277/641, 643
See application file for complete search history.

(56) References Cited

U.S. PATENT DOCUMENTS

| | | | | |
|---|---|---|---|---|
| 2,387,663 | A * | 10/1945 | Hosbein et al. | 110/339 |
| 2,910,155 | A * | 10/1959 | Bradner | 52/509 |
| 5,431,020 | A * | 7/1995 | Maghon | 60/753 |
| 2003/0056515 | A1 | 3/2003 | Bast et al. | |
| 2003/0079475 | A1 * | 5/2003 | Schmahl et al. | 60/752 |
| 2003/0089115 | A1 * | 5/2003 | Gerendas | 60/796 |
| 2003/0177770 | A1 | 9/2003 | Hofmann et al. | |

FOREIGN PATENT DOCUMENTS

| | | |
|---|---|---|
| DE | 41 14 768 A1 | 11/1991 |
| EP | 0 558 540 B1 | 9/1993 |
| EP | 1 128 131 A1 | 8/2001 |
| EP | 1 191 285 A1 | 3/2002 |
| EP | 1 288 601 A1 | 3/2003 |
| EP | 1 302 723 A1 | 4/2003 |

* cited by examiner

*Primary Examiner*—Michael Cuff
*Assistant Examiner*—Craig Kim

(57) ABSTRACT

A heat shield according to the invention on a support structure comprises a number of heat shield elements, which are configured and arranged on the support structure such that they abut each other leaving gaps. The support structure of the heat shield according to the invention has a peripheral direction and an axial direction, the heat shield elements abutting each other in the peripheral direction of the support structure leaving a gap, hereafter referred to as a peripheral gap, and in the axial direction of the support structure leaving a gap, hereafter referred to as an axial gap. Both the peripheral gaps and the axial gaps are also sealed by sealing elements, the sealing elements sealing the axial gaps being at a different distance from the support structure from the sealing elements sealing the peripheral gaps.

8 Claims, 5 Drawing Sheets

HEAT SHIELD

CROSS REFERENCE TO RELATED APPLICATIONS

This application is the US National Stage of International Application No. PCT/EP2004/053534, filed Dec. 16, 2005 and claims the benefit thereof. The International Application claims the benefits of European Patent application No. 04001689.1 filed Jan. 27, 2004. All of the applications are incorporated by reference herein in their entirety.

FIELD OF THE INVENTION

The present invention relates to a heat shield on a support structure having a peripheral direction and an axial direction, in particular for use in a gas turbine combustion chamber or a gas turbine flame tube, a heat shield element for use in such a heat shield, a combustion chamber equipped with a heat shield according to the invention, a flame tube equipped with a heat shield according to the invention and a gas turbine with a combustion chamber according to the invention or a flame tube according to the invention.

BACKGROUND OF THE INVENTION

Heat shields are used for example in combustion chambers or flame tubes, which may be part of a kiln, a hot gas duct or a gas turbine and in which a hot medium is generated or conveyed. For example a combustion chamber that is subject to a high level of thermal loading can be lined with a heat shield to protect it from excessive thermal strain. The heat shield typically has a number of heat shield elements arranged to provide a high level of coverage, which screen the walls of the combustion chamber from the hot medium, e.g. a hot combustion gas, and thereby counteract any excessive thermal loading of the combustion chamber wall.

Such a ceramic heat shield is for example disclosed in EP 0 558 540 B1. It comprises a number of square ceramic heat shield elements, which are attached to an axially symmetrical support structure of the flame tube. Each heat shield element has a hot side facing the hot medium, a cold side facing the supporting wall and four peripheral surfaces connecting the hot side to the cold side, the two peripheral surfaces of a heat shield element opposite each other in the peripheral direction of the support structure being provided with grooves. Spring-type clamps engaging in the grooves serve to fix the heat shield elements in the peripheral direction of the support structure, leaving a gap in between. To keep the thermal loading of the support structure as low as possible, a cooling fluid is fed to the gaps between the heat shield elements, flowing from the cold side towards the hot side through the gap, therefore blocking the gap to prevent penetration of the hot medium.

A ceramic heat shield that is particularly suitable for lining a flame tube for a gas turbine is disclosed for example in DE 41 14 768 A1. It comprises a number of square or trapezoidal ceramic heat shield elements, which are attached to a supporting wall of the flame tube. Each heat shield element has a hot side facing the hot medium, a cold side facing the supporting wall and four peripheral surfaces connecting the hot side to the cold side, two peripheral surfaces on opposite sides of a heat shield element being provided with grooves. Retaining elements with clamp sections are used to attach the heat shield elements to the supporting wall, engaging in the grooves in the peripheral surfaces and clamping the heat shield element in one direction. The retaining elements also each have a support section to support a heat shield element against a third peripheral surface. On the hot side this third peripheral surface has a projection projecting beyond the remainder of the peripheral surface, which rests on the support section of the retaining element such that the heat shield element is also secured in a direction perpendicular to the clamping direction. To allow thermal expansion of the heat shield elements, when they are exposed to the hot medium, the heat shield elements are arranged such that small gaps remain between them. With the fixing method disclosed in DE 41 14 768 A1 the heat shield elements are arranged at defined positions on the supporting wall.

A combustion chamber lining with heat shield elements is also disclosed in EP 1 302 723 A1. In this combustion chamber lining sealing elements are arranged in the gaps between the heat shield elements. The heat shield elements of this combustion chamber lining have grooves on their peripheral surfaces. A sealing element arranged in the gap between two heat shield elements thereby engages in the grooves in the two peripheral surfaces bounding the gap.

SUMMARY OF THE INVENTION

In contrast to the described prior art the object of the present invention is to provide an improved heat shield.

A further object of the present invention is to provide an improved heat shield element and an improved retaining element, which is particularly suitable for use in a heat shield according to the invention.

A further object of the present invention is to provide an improved combustion chamber and an improved flame tube.

Finally it is an object of the present invention to provide an improved gas turbine.

The first object is achieved by a heat shield according to the claims, the second object by a heat shield element according to the claims and a retaining element according to the claims, the third object by a combustion chamber according to the claims or a flame tube according to the claims and the fourth object by a gas turbine according to the claims.

The dependent claims contain advantageous embodiments of the invention.

A heat shield according to the invention on a support structure has a number of heat shield elements, which are configured and arranged on the support structure such that they abut each other, leaving a gap in between. The support structure of the heat shield according to the invention has a peripheral direction and an axial direction, the heat shield elements abutting each other in the peripheral direction of the support structure leaving a gap, hereafter referred to as a peripheral gap, and in the axial direction of the support stricture leaving a gap, hereafter referred to as an axial gap. Both the peripheral gaps and the axial gaps are also sealed by means of sealing elements, the sealing elements sealing the axial gaps being at a different distance from the support structure from the sealing elements sealing the peripheral gaps.

The heat shield according to the invention is based on the following observations and knowledge:

The heat shields used to line axially symmetrical combustion chambers such as annular combustion chambers of gas turbines, or flame tubes have heat shield elements, provided on two peripheral surfaces with grooves. Engagement sections of retaining elements engage in the grooves of these peripheral surfaces, to fix the heat shield elements in the peripheral direction of the support structure. In the axial direction the heat shield elements are either not fixed or fixing takes place, as disclosed in DE 41 14 768 A1, by means of support elements instead of by means of engagement sections engaging in grooves. The heat shield elements therefore have no grooves on their adjacent peripheral surfaces in the axial direction. The insertion of sealing elements, as disclosed in EP 1 302 723 A1, is therefore only possible between peripheral surfaces abutting in the peripheral direction, i.e. only peripheral gaps can be sealed with such seals. Accordingly to date sealing elements were only inserted in the peripheral gaps.

If the axial gaps are also to be sealed with sealing elements, the grooves could be continued in the peripheral surfaces abutting in the axial direction. Sealing elements could then be inserted in the axial gaps in the same way as in the peripheral gaps. Unsealed sections remain at the intersection points of the axial gaps and peripheral gaps, through which a cooling fluid can flow specifically into the combustion area.

The arrangement according to the invention of sealing elements for the axial gaps and peripheral gaps at different distances from the support structure makes it possible to arrange the sealing elements in an overlapping fashion. The intersection points between the axial and peripheral gaps are therefore sealed more effectively, thereby reducing the amount of cooling fluid required.

In particular the sealing elements that seal the axial gaps can be arranged between the support structure and the heat shield elements. There is then no need for a groove in the second peripheral surfaces.

The arrangement of the sealing elements at different distances from the support structure also allows assembly and disassembly of the components as required for service purposes.

In one advantageous embodiment of the invention the heat shield has a number of element retainers, which fix the heat shield elements on the support structure both in the peripheral direction and in the axial direction.

In addition to the seals, the gap dimensions of the heat shield are also of significance to the quantity of cooling fluid required for cooling purposes. The wider the gaps, the more cooling fluid is required to block the gaps effectively against the hot medium present in the combustion chamber.

During operation of the combustion chamber, the heat shields are exposed to both a high level of thermal loading and mechanical loading due to vibration. If the heat shield elements are not fixed in the axial direction of the support structure, they can be displaced axially, in particular when subject to such mechanical loading. However with axially symmetrical, in particular tapered, combustion areas or flame tubes, such displacement results in changes in the axial gaps and the peripheral gaps between the heat shield elements. If the heat shield elements are displaced on the support structure, the gaps between them may be reduced or increased, resulting in irregular discharge of the cooling fluid and irregular temperature gradients in the gaps. A greater quantity of fluid is therefore required to block the gaps allowing for all gap tolerances in all operating conditions. Allowing for increased gaps in particular increases the cooling fluid requirement. Also if the heat shield elements are not fixed axially, subsequent work is required in each individual instance during assembly due to the lack of precisely defined axial position and this increases assembly time.

Axial fixing allows effective suppression of the displacement of the heat shield elements, so that smaller gap tolerances can be assumed when determining the cooling fluid requirement, which means that the cooling fluid requirement can be reduced. The cooling fluid requirement can therefore be significantly reduced in particular in conjunction with seals arranged both in the axial and peripheral gaps. Axial fixing also results in more regular temperature gradients at the heat shield elements and more regular thermal stresses. As a result, when the heat shield elements are subject to thermal loading, fewer or shorter cracks occur, thereby reducing the replacement rate for heat shield elements and allowing inspection intervals to be extended. Finally axial fixing allows the assembly time required for adjusting gap tolerances in new structures and when maintaining a heat shield to be shortened.

In a first variant of the heat shield with axial fixing of the heat shield elements, the heat shield comprises first element retainers to fix the heat shield elements in the peripheral direction of the support structure and second element retainers to fix the heat shield elements in the axial direction of the support structure. The second element retainers are thereby configured at the same time to retain the sealing elements in the axial gaps. As the second element retainers also retain the sealing elements, there is no need for an additional retaining element as would be required with the axial fixing according to the prior art for retaining a sealing element disclosed in DE 41 14 768 A1.

In a configuration of this variant that can be achieved without major technical outlay, the support structure has peripheral grooves that extend in the peripheral direction of the support structure. The second element retainers are configured as clamps with a clamp opening and a clamp section facing away from the clamp opening, the clamps with the clamp sections facing away from the clamp openings being inserted into a peripheral groove in the support structure such that at least part of the clamp projects beyond the peripheral groove to engage in a recess in a heat shield element, thus serving as an axial fixing for the heat shield element. The sealing elements are thereby inserted into the clamps.

To ensure that the seal is securely retained in the clamp opening, the clamp can also have engagement elements to engage in a sealing element inserted in the clamp.

In a second variant of the heat shield with axial fixing of the heat shield elements, the heat shield elements each comprise a hot side facing away from the support structure, which is suitable for exposure to a hot medium, a cold side facing towards the support structure and a number of peripheral surfaces connecting the hot side to the cold side. A heat shield element has first peripheral surfaces on two opposite sides, said peripheral surfaces each abutting a corresponding first peripheral surface of an adjacent heat shield element in the axial direction of the support structure, leaving an axial gap. In the region of the edges between the cold side and the first peripheral surfaces are recesses, which interact with the recess in the respective axially opposite peripheral surface of the adjacent heat shield element to form a seat running in the peripheral direction of the support structure for a sealing element or a plurality of sealing elements. The heat shield element also has second peripheral surfaces on two opposite sides, each of said second peripheral surfaces abutting a corresponding second peripheral surface of an adjacent heat shield element in the peripheral direction of the support structure, leaving a peripheral gap. To fix the heat shield elements in the peripheral direction of the support structure the element retainers engage in the second peripheral surfaces of the heat shield elements, the second peripheral surfaces being equipped with securing sections, which prevent displacement of the heat shield elements along the second peripheral surfaces in relation to the element retainers.

In the variant described above, the element retainers, which fix the heat shield elements in the peripheral direction, are also responsible for fixing in the axial direction. No additional element retainers are required in addition to the element retainers which are present anyway to fix the heat shield elements in the peripheral direction of the support structure. Only the securing sections have to be incorporated in the heat shield elements, which only represents a slight modification compared with the design of the heat shield elements used to date.

In one embodiment of the second variant the second peripheral surfaces have grooves, in which engagement sections of the element retainers engage and in which studs are arranged such that they form a stop for the engagement sections of the element retainers in the axial direction of the support structure. The studs therefore form the securing sections, which prevent displacement of the element retainers along the second peripheral surfaces.

A heat shield element according to the invention for attachment to a support structure comprises a hot side to be turned away from a support structure, which is suitable for exposure to a hot medium, a cold side to be turned towards the support structure and a number of peripheral surfaces connecting the hot side to the cold side, which are provided to abut peripheral surfaces of heat shield elements to be positioned in an adjacent fashion in the peripheral direction of the support structure, leaving the peripheral gap and have grooves for engaging with engagement sections of element retainers, which hold the heat shield element on the support structure. At least one stud is arranged in each groove, forming a stop for the engagement sections of the element retainers. A heat shield element thus configured can also be fixed in the axial direction with the standard element retainers used to date for fixing in the peripheral direction of the support structure. It is particularly suitable for use in a heat shield according to the second variant of the heat shield according to the invention with axial fixing of the heat shield elements.

The at least one stud extends in a first configuration of the heat shield element according to the invention in a direction from the cold side to the hot side only through part of the groove profile. This does not interfere significantly with insertion of the standard sealing elements used to date in the groove. Alternatively the at least one stud can extend in a direction from the cold side to the hot side through the entire groove profile. In this embodiment it is necessary to modify the sealing elements to be inserted into the groove but a stud that passes right through increases the strength of the heat shield element, particularly in the region of the groove.

A retaining element according to the invention with an engagement section configured to engage in the grooves of heat shield elements has at least one surface element on the engagement section, the surface normal of which runs in the direction of expansion of the groove on engagement in the groove. The retaining element according to the invention provides a larger stop surface for stopping against the studs arranged in the grooves and can thereby ensure secure axial fixing of the heat shield element.

A combustion chamber according to the invention or a flame tube according to the invention is equipped with a heat shield according to the invention and a gas turbine according to the invention is equipped with a combustion chamber according to the invention or a flame tube according to the invention.

BRIEF DESCRIPTION OF THE DRAWING

Further features, characteristics and advantages of the invention will emerge from the detailed description which follows of exemplary embodiments with reference to the attached drawings, in which.

DETAILED DESCRIPTION OF THE INVENTION

Figure 1:
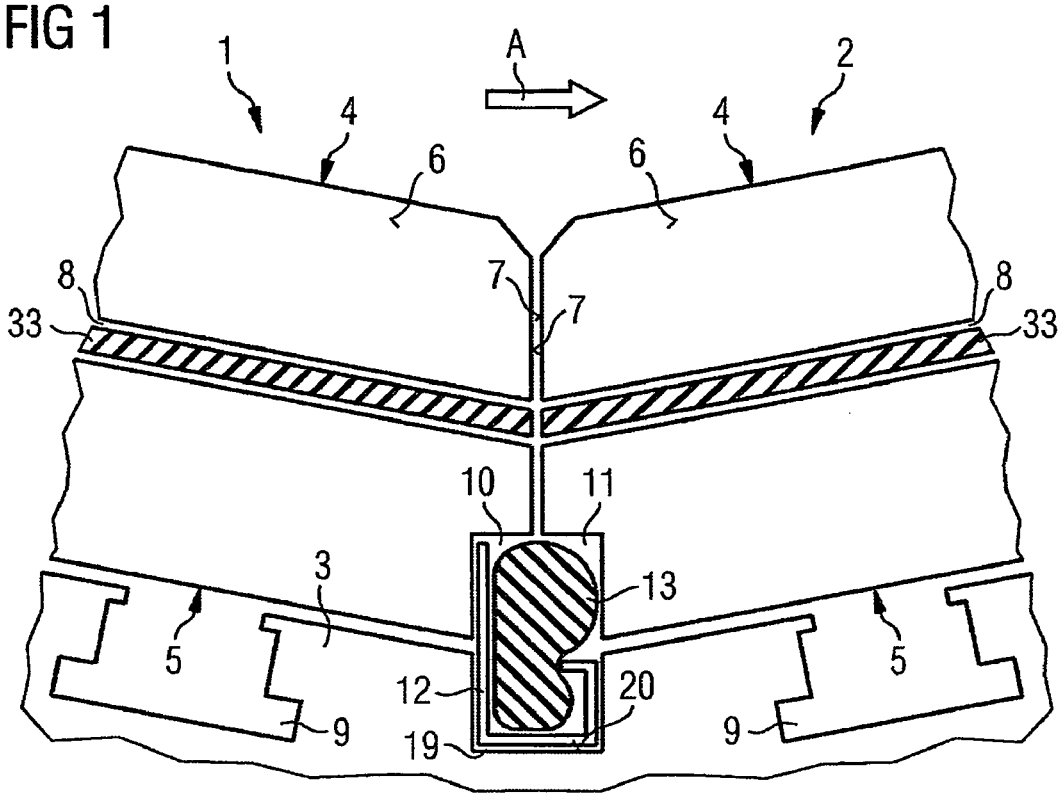
FIG. 1 shows a schematic side view of a first exemplary embodiment of the invention.

FIG. 1 shows a first exemplary embodiment of the heat shield according to the invention in the form of a section of an axially symmetrical heat shield for an annular combustion chamber of a gas turbine. The figure shows two ceramic heat shield elements 1, 2, which are fixed to an axially symmetrical support structure and abut each other in the axial direction A of the support structure 3. Support structure 3 may be the structure sought to be protected from the heat. For example, support structure 3 may be the wall of a combustion chamber, or a flame tube. In order not to impede the thermal expansion of the heat shield elements 1, 2 during operation of the gas turbine combustion chamber, the heat shield elements are arranged such that a small gap remains in each instance between two heat shield elements 1, 2. If the heat shield elements were to push up against each other due to thermal expansion, this could lead to stresses in the heat shield elements 1, 2 and thus to early wear or even to fracture of a heat shield element 1, 2.

The heat shield elements 1, 2 each have a heat resistant hot side 4 facing the inside of the combustion chamber, which is exposed to the hot gas in the gas turbine combustion chamber during operation of the gas turbine, and a cold side 5 facing the support structure 3. Between the hot sides 4 and the cold sides 5 the heat shield elements 1, 2 each have four peripheral surfaces 6, 7, with which the heat shield elements 1, 2 abut adjacent heat shield elements 1, 2. The peripheral surfaces 6, with which the heat shield elements 1 abut in the peripheral direction of the support structure 3, have grooves 8, in which engagement sections of element retainers can engage, to fix the heat shield elements 1, 2 in the peripheral direction of the support structure 3.

Figure 8:
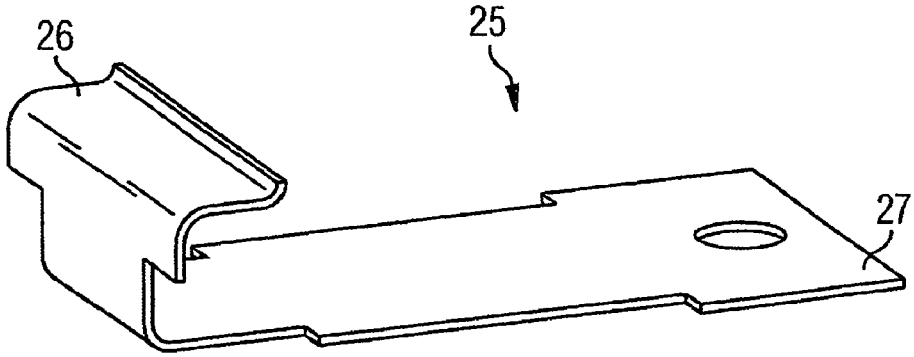
FIG. 8 shows a first example of an element retainer for fixing a heat shield element according to the invention.

An element retainer 25, as used in the present exemplary embodiment for fixing the heat shield elements 1, 2, is shown in FIG. 8. The element retainer 25 has an engagement section configured as an engagement plate 26 to engage in the groove 8 of a heat shield element 1, 2 and an attachment plate 27, which can be used to attach the element retainer 25 to the support structure 3. To fix the element retainer 25 to the support structure 3, said support structure 3 has profiled grooves 9 running in the peripheral direction, in which the attachment plates 27 of the element retainers 25 can for example be fixed by means of screws on the support structure 3. A corresponding retainer and its attachment in the profiled groove of the support structure is also disclosed in EP 0 558

540, to which reference is made for the further configuration and attachment of the element retainer.

Sealing elements 33, for example ceramic seals, are also inserted into the grooves 8 of the retaining elements 1, 2, to seal the peripheral gaps between two heat shield elements abutting each other in the peripheral direction.

The peripheral surfaces 7 of the heat shield elements 1, 2 abutting each other in the axial direction A of the support structure have no grooves. Instead each heat shield element 1, 2 has first and second recesses 10, 11 on its axial edges, i.e. the edges between the two peripheral surfaces 7 and the cold side 5 of a heat shield element. Only one recess can be seen in the two heat shield elements in FIG. 1.

Figure 2:
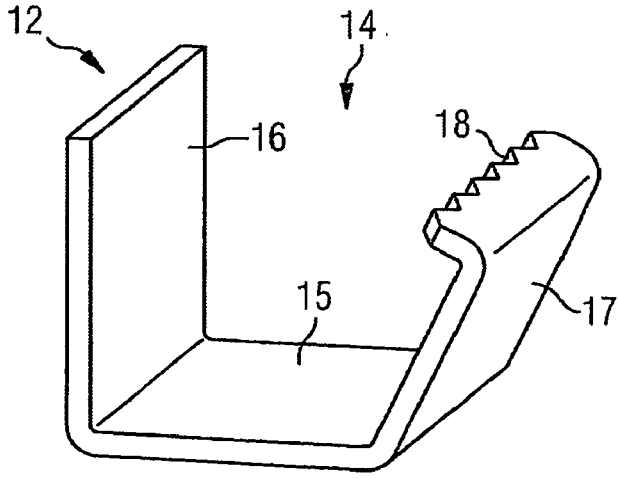
FIG. 2 shows a retaining clamp of the first exemplary embodiment.

The first recess 10 serves both to hold part of a clamp 12, shown enlarged in FIG. 2, and also to hold part of a sealing element 13 inserted into the clamp 12 and retained by this to seal the axial gap between the heat shield elements 1, 2. The second recess 11 in contrast only serves to hold part of the sealing element 13. The sealing elements can particularly be configured as preferably ceramic tube elements.

The clamp 12, which is preferably made of an elastic material, for example steel, has a clamp opening 14 and a stud 15 facing away from the clamp opening (see FIG. 2). Extending away from the stud 15 are a first clamp section 16 and a second clamp section 17, which together bound the clamp opening 14. The first clamp section 16 and the stud 15 thereby essentially form a 90° angle, while the second clamp section 17 and the stud 15 form an angle great than 90°. At the end of the second clamp section 17 furthest away from the stud 15 are jagged projections 18 projecting towards the first clamp section 16, which are provided to engage in a sealing element 13 inserted into the clamp 12. The tips of the jagged projections 18 are preferably rounded to prevent damage to the sealing element 13.

Figure 3:
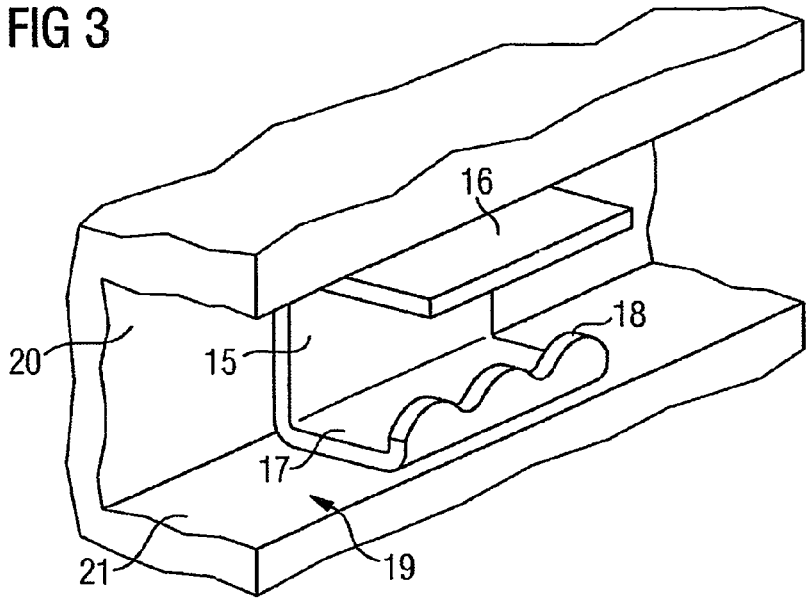
FIG. 3 shows the retaining clamp from FIG. 2 when inserted into a groove in the support structure.

The ends of the clamps 12 facing away from the clamp opening 14 are inserted into a peripheral groove 19 configured in the support structure 13 such that the stud 15 is at the base of the groove 20. The second clamp section is thereby pressed by the groove wall 21 towards the first clamp section 16, as a result of which the clamp 12 is held by tension in the groove 19. The jagged projections 18 also thereby engage in a sealing element 13 (not shown in FIG. 3) inserted into the clamp 12, so that said sealing element 13 is retained by the clamp 12.

When the clamp 12 is inserted in the peripheral groove 19, the first clamp section 16 projects beyond the peripheral groove 19, while the second clamp section 17 is arranged completely within the peripheral groove 19. When the heat shield elements 1, 2 are then attached to the support structure 3, the part of the first clamp section 16 projecting beyond the peripheral groove 19 engages in the first recess 10 in the heat shield element 1 (see FIG. 1), thereby fixing it so that it cannot be displaced in the axial direction A of the support structure 3. The clamp 12 therefore serves at the same time as a retainer for the sealing element 13 and as a retaining element to fix the heat shield element 1 in an axial fashion. As the first recess 10 has to accommodate both the first clamp section 16 and part of the sealing element 13, it has a larger dimension in the axial direction A of the support structure than the second recess 11, which only has to accommodate part of the sealing element.

Because the sealing element 13 is at a different distance from the support structure 3 from the sealing elements 33 inserted into the grooves 8 in the heat shield elements 1, 2, all the sealing elements can extend to the edge of the corresponding heat shield element or in some instances even beyond it, without impeding each other. It also means in particular that the intersection points of peripheral and axial gaps can be effectively sealed.

Figure 4:
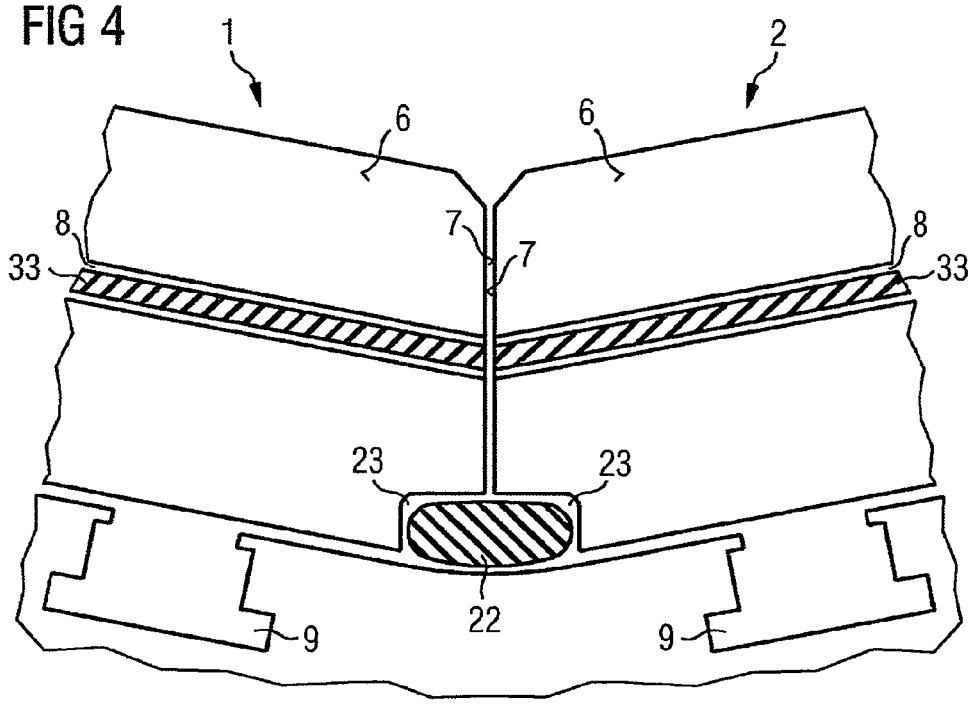
FIG. 4 shows a second exemplary embodiment of the heat shield according to the invention.

A second exemplary embodiment of the heat shield according to the invention is shown in FIG. 4. In the second exemplary embodiment structures, which are also present in the first exemplary embodiment, are assigned the same reference characters. In contrast to the sealing element 13 of the first exemplary embodiment shown in FIG. 1, the sealing element 22 in the second exemplary embodiment is not inserted into a peripheral groove 19 of the support structure 3 by means of a clamp 12. Instead it rests on the support structure 3. It can also optionally be attached to the support structure 3 by means of appropriate attachment elements, such as clips to be screwed or otherwise fixed to the support structure 3. As in the first exemplary embodiment the heat shield elements 1, 2 have recesses 23 on their axial edges to accommodate part of the sealing element 22. In contrast to the first exemplary embodiment however, the dimensions of the recesses 23 at the two axial edges of a heat shield element do not differ.

Figure 4A:
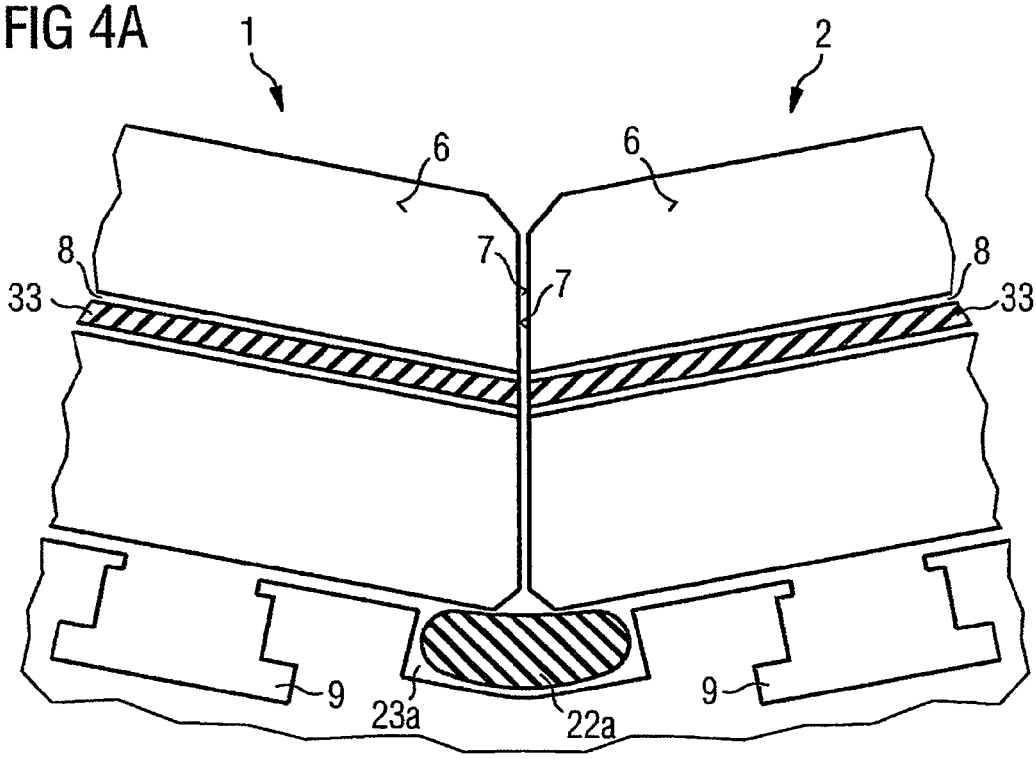
FIG. 4*a* shows a modification of the second exemplary embodiment shown in FIG. 4.

A modification of this exemplary embodiment is shown in FIG. 4*a*. Unlike the exemplary embodiment shown in FIG. 4 there are no recesses present at the axial edges of the heat shield elements 1, 2 to accommodate the sealing element 22. Instead the support structure has a further groove 23*a* running in the peripheral direction in the region of the axial edges of the heat shield elements 1, 2 to accommodate a sealing element 22*a* sealing the gap between the heat shield elements 1, 2.

As there is no clamp retaining the sealing element 22 in the second exemplary embodiment, the heat shield elements 1, 2 are only fixed in the peripheral direction of the support structure 3 by the element retainers engaging in the groove 8. If the heat shield elements 1, 2 are also to be fixed in the axial direction of the support structure 3, this can be achieved in a modification of the second exemplary embodiment, by arranging studs 24 in the grooves 8 of the heat shield elements 1, 2, which form a stop for the engagement plates 26 of the element retainers 25 engaging in the grooves 8 and prevent displacement of the heat shield element in the axial direction A of the support structure 3 in relation to the element retainer 25 and therefore also in relation to the support structure 3 (see FIG. 5 and FIG. 6). In particular, when engagement plates 26 of element retainers 25 engage in the groove 8 at both sides of the studs 24, the heat shield element is secured to prevent axial displacement.

Figure 5:
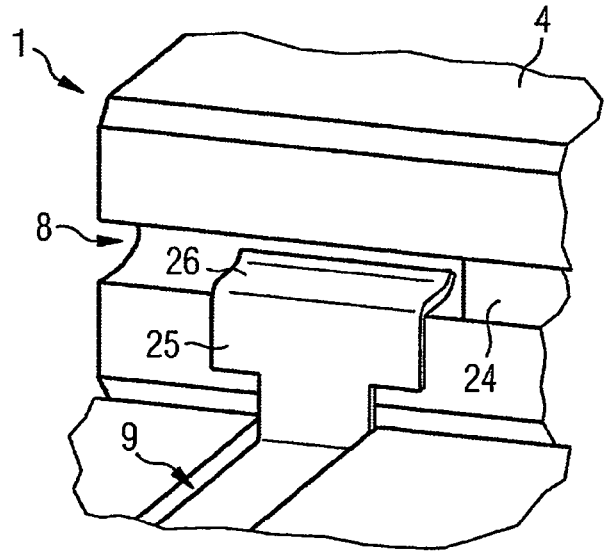
FIG. 5 shows an element retainer engaged in the groove of a heat shield element.
Figure 6:
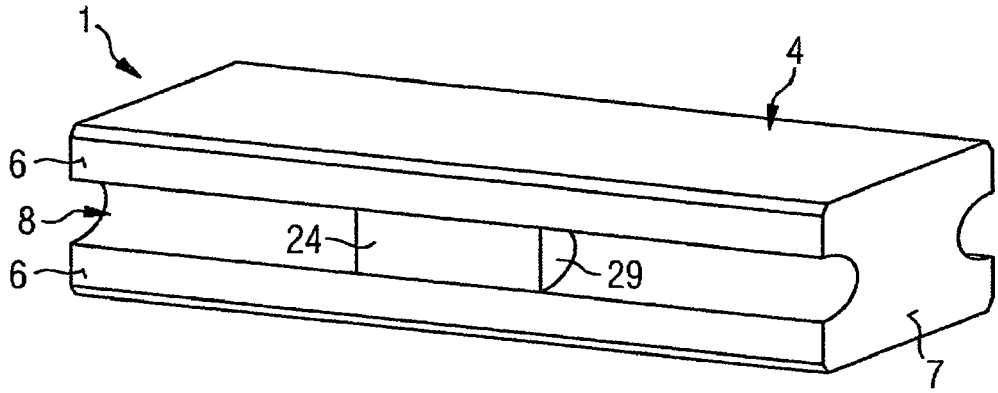
FIG. 6 shows a first exemplary embodiment of a heat shield element according to the invention.

In the case of the heat shield element shown in FIGS. 5 and 6, the stud 24 extends through the entire cross section of the groove, providing a large stop surface 29 and enhancing the stability of the heat shield element 1, in particular its peripheral surface 6. However such a large stud 24 means that the shape of the sealing elements 33 to be inserted into the groove 8 has to be adapted.

Figure 7:
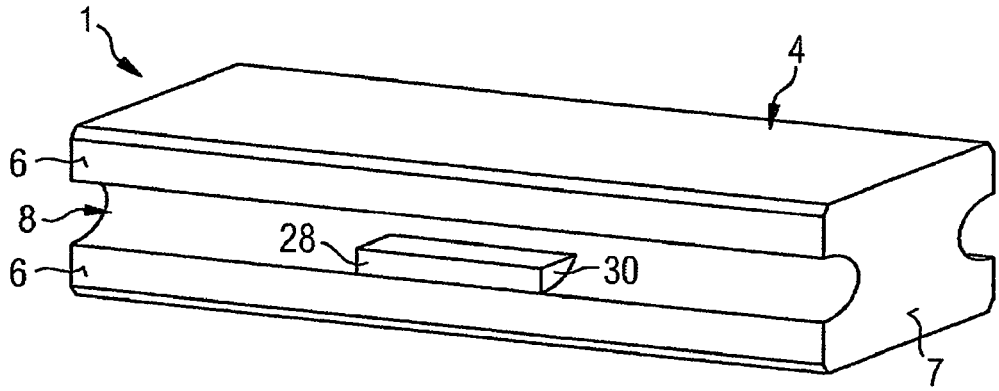
FIG. 7 shows a second exemplary embodiment of a heat shield element according to the invention.

An alternative embodiment of the stud is shown in FIG. 7. In this embodiment the stud 28 only extends through a small part of the groove profile 8, so that sufficient space remains for the sealing element 33 to be inserted into the groove 8. The shape of the sealing elements 33 to be inserted into the groove 8 in this embodiment does not have to be modified.

To be able to utilize the stop surface 29, 30 provided by the stud 24, 28 more effectively, it is advantageous if the engagement plate 26 of the element retainer 25 is modified slightly. Exemplary embodiments of corresponding element retainers are shown in FIGS. 9 and 10.

Figure 9:
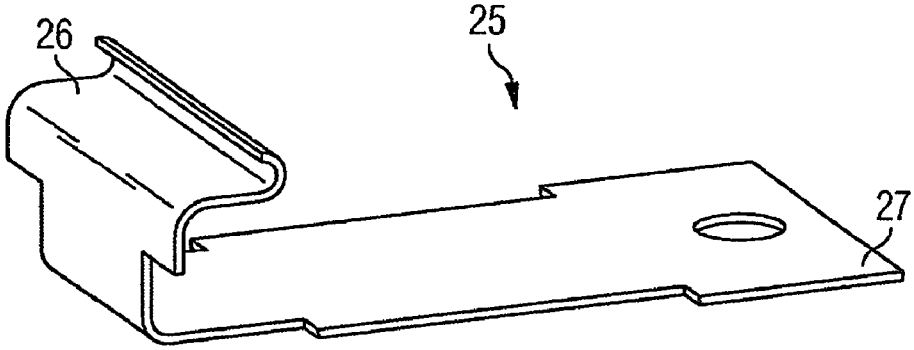
FIG. 9 shows a second example of an element retainer for fixing a heat shield element according to the invention.

In the exemplary embodiment of an element retainer 25 according to the invention shown in FIG. 9, the engagement plate 26 of the element retainer 25 has a semicircular bend 31 at the end configured to engage in the groove 8. This configuration means that a larger edge section of the engagement plate 26 is available for the stop at the stop surface 29, 30 of the stud 24, 28.

Figure 10:
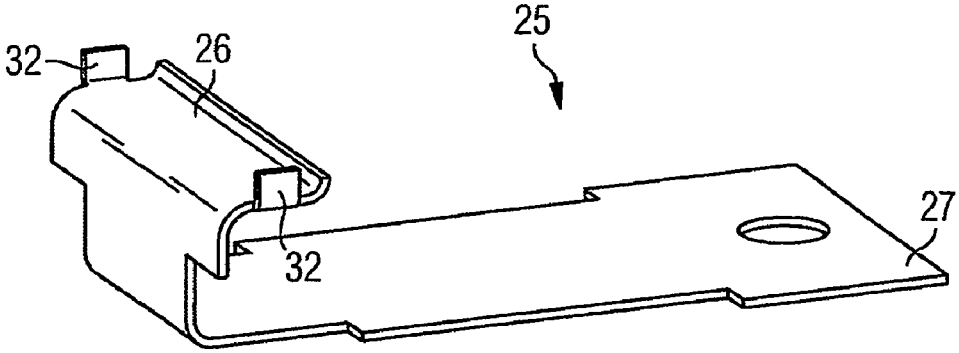
FIG. 10 shows a third example of an element retainer for fixing a heat shield element according to the invention.

In the exemplary embodiment of an element retainer 25 according to the invention shown in figure 10 surface elements 32 are arranged on the sides of the engagement plate 26, the surface normal of which points in the direction of expansion of the groove 8, i.e. along the longitudinal axis of the groove, when the engagement plate 26 is engaged in the groove 8. As the surface normals of the stop surfaces 29, 30 also point in the direction of expansion of the groove 8, the surface elements 32 form counter-surfaces for stopping at the stop surfaces 29, 30 of the studs.

The engagement plate 26 of the engaging engagement element 25 engages on at least one side of the stud 24, 28 at a small distance from the stop surfaces 29, 30 of the studs 24, 28, in order not to impede the thermal expansion of the studs. However the distance is thereby significantly smaller than the width of the axial gap between two heat shield elements. If the engagement plates 26 engage in the groove 8 at a small distance from the stop surfaces 29, 30, the heat shield element 1 may be displaced slightly axially in the axial direction A of the support structure, but the extent of this possible axial displacement of the heat shield element 1 is significantly smaller than the width of the axial gap, so that the gap tolerances are not noticeably infringed. The heat shield element should therefore still always be deemed to be fixed axially, when the engagement plates 26 engage in the groove 8 at a short distance from the stop surfaces 29, 30.

The heat shield elements illustrated in the exemplary embodiments, the element retainers and the support structure illustrated in the exemplary embodiments can be produced quickly and economically by modifying the heat shield elements used to date(in-corporation of recesses 10, 11, 23 and/or studs 24, 28), the element retainers (modification of the engagement plate 26) and the support structure used to date (incorporation of the peripheral groove 19).

When producing a heat shield according to the invention combinations of axially fixed heat shield elements and heat shield elements that are not axially fixed are also possible.

The invention claimed is:

1. A heat shield for use in a gas turbine, comprising:

a support structure that extends in a peripheral and axial direction;

a plurality of heat shield elements arranged on the support structure abutting each other in a peripheral and axial directions of the supporting structure and having an axial gap and a peripheral gap between the heat shield elements;

a plurality of first sealing elements, disposed between the heat shield elements, that seal the peripheral gaps;

a plurality of second sealing elements, disposed between the support structure and the heat shield elements, that seal the axial gaps, wherein the second sealing elements that seal the axial gaps are at a different distance from the support structure than the first sealing elements that seal the peripheral gaps; and a plurality of first element retainers securing the heat shield elements to the support structure in the peripheral direction of the support structure; and a plurality of second element retainers securing the heat shield elements to the support structure in the axial direction of the support structure, the second element retainers configured to also retain the second sealing elements in the axial gaps.

2. The heat shield according to claim 1, wherein:

the support structure has peripheral grooves extending in the peripheral direction of the support structure, the second element retainers are configured as clamps with a clamp opening and a clamp section facing away from the clamp opening, and the clamp section is inserted into a peripheral groove in the support structure, such that at least part of the clamp projects beyond the peripheral groove to engage in a recess in a heat shield element to secure the heat shield element axially, wherein inserting the clamp section clamps the second sealing elements that are inserted in the clamp section.

3. The heat shield according to claim 2, wherein the clamp has engagement elements that engage a sealing element inserted into the clamp.

4. The heat shield according to claim 1, wherein the heat shield elements comprise:

a hot side facing away from the support structure suitable for exposure to a hot medium, a cold side facing towards the support structure, and a number of peripheral surfaces connecting the hot side to the cold side wherein first peripheral surfaces at two opposite sides of the heat shield element each abut a corresponding first peripheral surface of an adjacent heat shield element in the axial direction of the support structure to form an axial gap, and second peripheral surfaces at two opposite sides of the heat shield element each abut a corresponding second peripheral surface of an adjacent heat shield element in the peripheral direction of the support structure to form a peripheral gap, recesses formed between adjacent heat shield elements in the region of the edges between the cold side and the first peripheral surfaces interact with the recess of the respective opposite peripheral surface of the adjacent heat shield element in the axial direction to form a holder for a sealing element arranged along the peripheral direction of the support structure, the element retainers engage in the second peripheral surfaces of the heat shield elements, and the second peripheral surfaces configured with securing sections which prevent displacement of the heat shield element relative to the element retainers along the second peripheral surfaces.

5. The heat shield according to claim 4, wherein the second peripheral surfaces have grooves where engagement sections of the element retainers engage and where studs are arranged to form a stop for the engagement sections of the element retainers in the axial direction of the support structure.

6. A heat shield element for use in a heat shield, comprising:

a hot side exposed to a hot medium arranged opposite a support structure;

a cold side arranged toward the support structure; and a plurality of peripheral surfaces connecting the hot side to the cold side which are provided to abut peripheral surfaces of adjacent heat shield elements, a peripheral direction of the support structure providing a peripheral gap and having grooves with a groove profile for engagement with engagement sections of element retainers which retain the heat shield element on the support structure, a recess formed in the corners of the heat shield element where the cold side and the axial peripheral surface intersect which, when assembled with other heat shield elements, forms a second, larger recess:

wherein a stud is arranged in each groove to form a stop for the engagement sections of the element retainers.

7. The heat shield element according to claim 6, wherein the stud extends through only part of the groove profile.

8. The heat shield element according to claim 6, wherein the stud extends through the entire groove profile.

* * * * *